US005217326A

United States Patent [19]

Bullivant

[11] Patent Number: 5,217,326

[45] Date of Patent: Jun. 8, 1993

[54] SUPPORTS FOR BUILDING STRUCTURES

[75] Inventor: Roger A. Bullivant, Newton Solney, United Kingdom

[73] Assignee: Roger Bullivant of Texas, Inc., Grand Prairie, Tex.

[21] Appl. No.: 927,332

[22] Filed: Aug. 10, 1992

[30] Foreign Application Priority Data

Aug. 10, 1991 [GB] United Kingdom ..... 9117337

[51] Int. Cl.[5] ..... E02D 5/38; E02D 27/00

[52] U.S. Cl. ..... 405/233; 52/294; 405/229

[58] Field of Search ..... 405/229, 230, 231, 232, 405/233, 244, 256, 257; 52/169.1, 169.9, 294, 296

[56] References Cited

U.S. PATENT DOCUMENTS

| | | | |
|---|---|---|---|
| 844,295 | 2/1907 | Winslow | 405/229 |
| 2,960,745 | 11/1960 | Wallace | 405/229 |
| 3,269,126 | 8/1966 | Freeman | 405/230 |
| 4,338,047 | 7/1982 | David | 405/230 |
| 4,754,588 | 7/1988 | Gregory | 52/294 |
| 4,838,737 | 6/1989 | Quimby | 405/229 X |

*Primary Examiner*—David H. Corbin
*Attorney, Agent, or Firm*—Richards, Medlock & Andrews

[57] ABSTRACT

A building method is provided that avoids the use of the traditional excavated foundation. The method comprises placing primary support members (10) into the ground in which the structure is to be built at predetermined intervals, spanning the gap between support members (10) by pre-cast reinforced concrete beams (14) of generally inverted T-shape and predetermined length and building, for example, a double skin wall (42, 44) on the outer flange (22) and top of the beam while the inner flange (22) supports a floor slab of beams (40) blocks (46) and screed (48) and abuts the inner face (31) of the upright of the beam to resist inward lateral movement thereof.

12 Claims, 5 Drawing Sheets

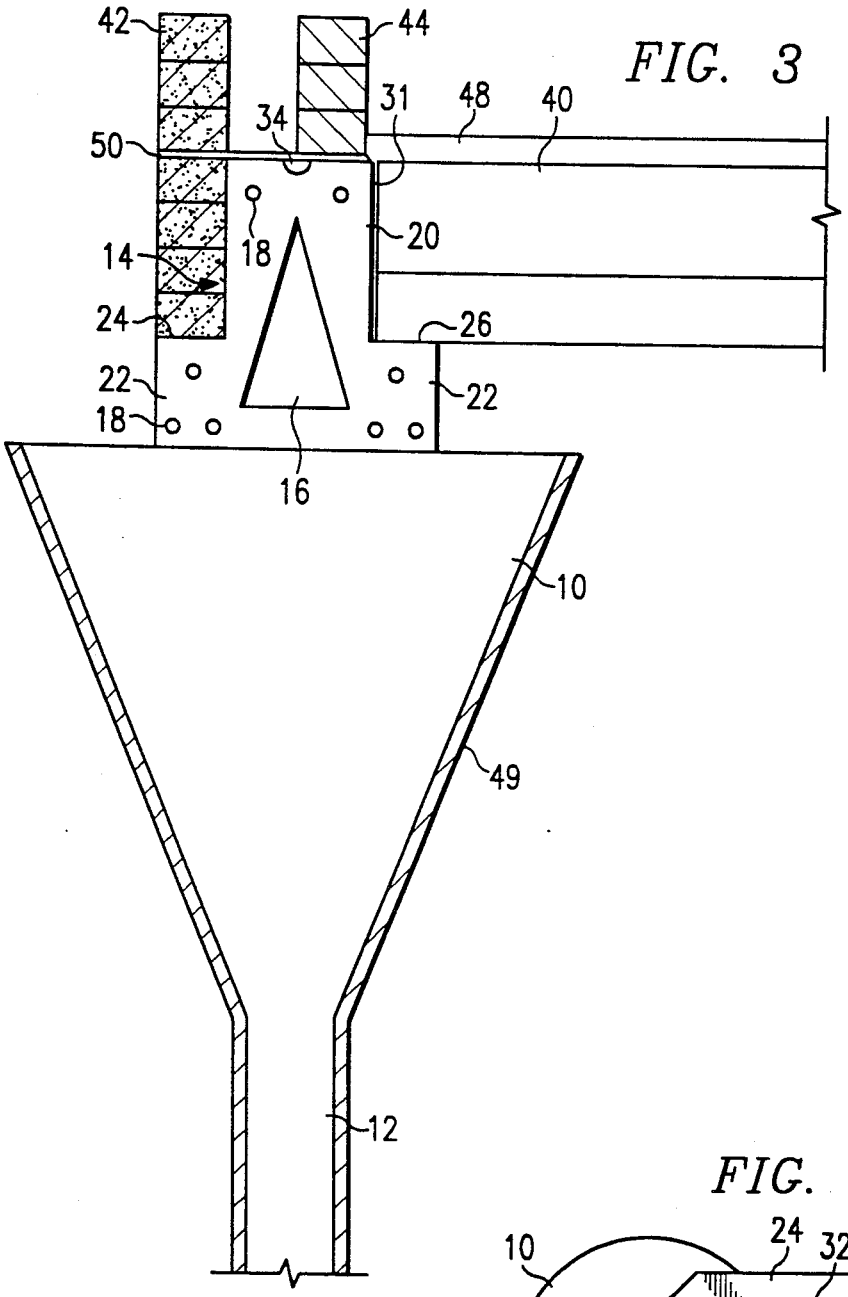
FIG. 3
FIG. 4
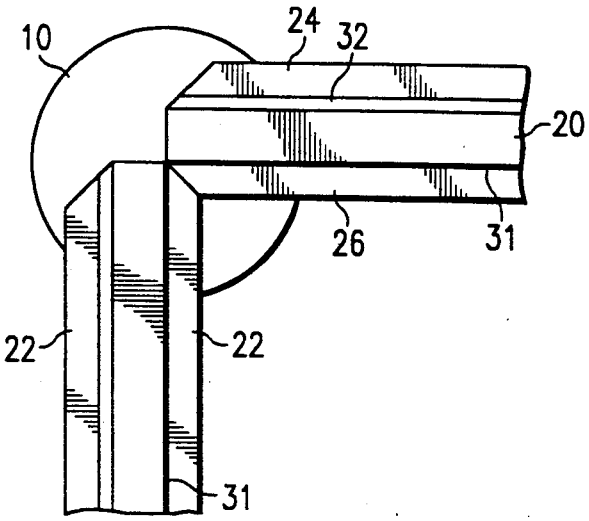

SUPPORTS FOR BUILDING STRUCTURES

TECHNICAL FIELD OF THE INVENTION

The present invention concerns improvements in or relating to supports for building structures for example, single or multi-story houses, offices, warehouses, retail outlets and factories.

BACKGROUND OF THE INVENTION

The most commonly employed support structure is a foundation which is normally cast in situ by excavating a trench and casting a concrete beam in the trench with or without the use of shuttering.

It has been proposed in the past to provide an alternative system by casting in situ a plurality of spaced primary support structures, supporting on these structures pre-cast beams and utilizing the thus formed ring beam as a foundation. A proposal of this nature is set out in our U.K. Patent 21860098. In certain applications this system exhibits considerable advantages but in others, a disadvantage which has been encountered, especially where the reinforced beam is not securely fixed to the primary support, is instability when the building structure is subjected to lateral loads, for example, wind loading.

SUMMARY OF THE INVENTION

It is an object of the present invention to obviate or mitigate this and other disadvantages.

According to the present invention there is provided a method of supporting a building structure comprising forming in the ground on which the building has to be constructed a plurality of primary supports at spaced intervals, spanning the gap between adjacent supports by pre-cast concrete beams, each of which has a lateral projection provided at its base on each side thereof, supporting a wall or walls of the structures on said beams and arranging a floor slab of said structure alongside said beam to restrain inward lateral movement of the beam.

Preferably a first wall is supported on one projection of the beams and the floor slab on the other projection. If the wall is of cavity construction, the inner wall is supported on the top of the beams.

Preferably the beams are formed by a slip casting technique and include a central through passage.

Preferably each beam is cut from a longer length of pre-fabricated beam to a length equal to the distance between two primary supports to be spanned by the beam.

Preferably the spacing between the primary supports is determined on ground and load conditions.

Preferably a pile projects from the bottom of the primary support.

Preferably the primary support is formed by driving a conical steel casing into the ground at the desired location and pouring concrete into the thus formed hole. Alternatively, the primary support is formed by operating a conical auger to form a conical hole and pouring concrete into the thus formed hole.

Preferably, prior to pouring the concrete, when the primary support is formed in ground subjected to heave, a lining permitting relative movement between the surrounding ground and the support is fitted into the formed hole. Additionally, the underside of the beam between the support columns is isolated from the underlying ground by a layer of compressible material.

Preferably the primary support is formed by driving a precast reinforced concrete pile and fitting a cap member to the top thereof by passing an exposed length of reinforcement through a passage in the member and attaching the member to the pile by means of a settable material located between the member and the reinforcement and/or the top of the pile. Alternatively the primary support is formed by forcing a hollow inverted frusto-conical concrete member into the ground and fixing a slab over the top thereof. A pile may be driven through the member and attached thereto by filling the member with concrete.

Preferably the floor slab is formed by laying a plurality of space inverted T-section beams on the inner projection of the beam, the gap therebetween is filled by blocks laid between the beams and a composite slab is formed by applying a cementitious material over the beam and block tops.

Alternatively pre-cast sectional floor slabs may be employed.

Preferably means are provided for interconnecting neighboring beams and their ends. The ends may be interconnected at an angle. The angle may be a right angle and the beams may be interconnected to form an L-shaped, T-shaped or X-shaped corner crossings.

Preferably the beams are interconnected at said corners by laying suitably shaped steelwork in longitudinally extending grooves formed in the beam tops and fixing the steelwork therein.

Preferably the lateral projection from the outer side of the beam is of a thickness greater than the thickness of the outer wall and a step is provided extending between the outer face of the beam and the projection to provide support for the projection and the wall resting thereon.

BRIEF DESCRIPTION OF THE DRAWINGS

An embodiment of the present invention will now be described by way of example only with reference to the accompanying drawings, in which:

FIG. 3 shows a cross-section through a further modified support for a building;

FIG. 4 shows a plan of the support for a building as shown in FIG. 1 or FIG. 2 at a corner thereof;

DETAILED DESCRIPTION

Figure 2:
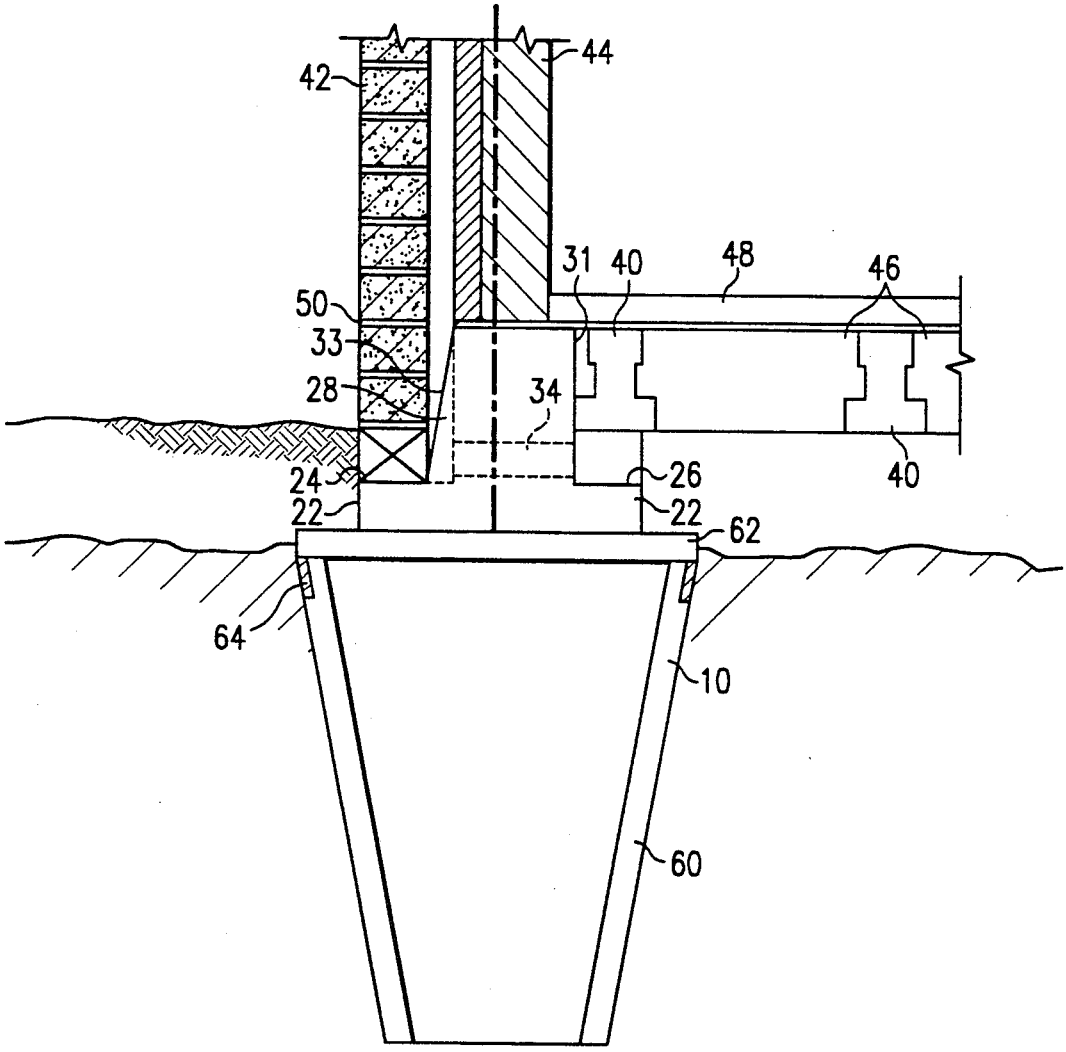
FIG. 2 shows a cross-section through a modified support for a building.

A support for a building comprises a plurality of spaced apart primary support members 10 each comprising an upper support structure having a pile 12 extending downwardly therefrom. In good ground the pile need not be provided as shown in FIG. 2.

The primary support members are arranged at precalculated spaced intervals along the line of a wall to be supported and the space between neighboring members is spanned by a pre-cast concrete beam 14. The beam is provided with suitable pre-tensioned steel reinforcing wires or rods 18 and reinforcing links 19. Beams of this nature lend themselves to construction by a vibratory casting technique and are produced in made-to-measure lengths.

The beam has an upstanding portion or web 20 at the base of which and from each side of which project protrusions or flanges 22, each protrusion presenting an upwardly directed face 24, 26 which is arranged to be horizontal in use. Conveniently the faces 24 and 26 are at the same level but this need not be the case.

The upstanding portion or web 20 of the beam is substantially rectangular in cross-section with its central vertical axis spaced to one side of the central vertical axis of the base of the beam including the flanges 22.

The face of the portion 20 which will be to the outside of the building in use, is provided with an outwardly stepped portion 28 at its lower end, the portion 28 merging into the vertical outer side 30 over an inclined portion 32. Air passages 34 are provided at spaced intervals through the web and are formed during the casting of the beam.

Figure 1:
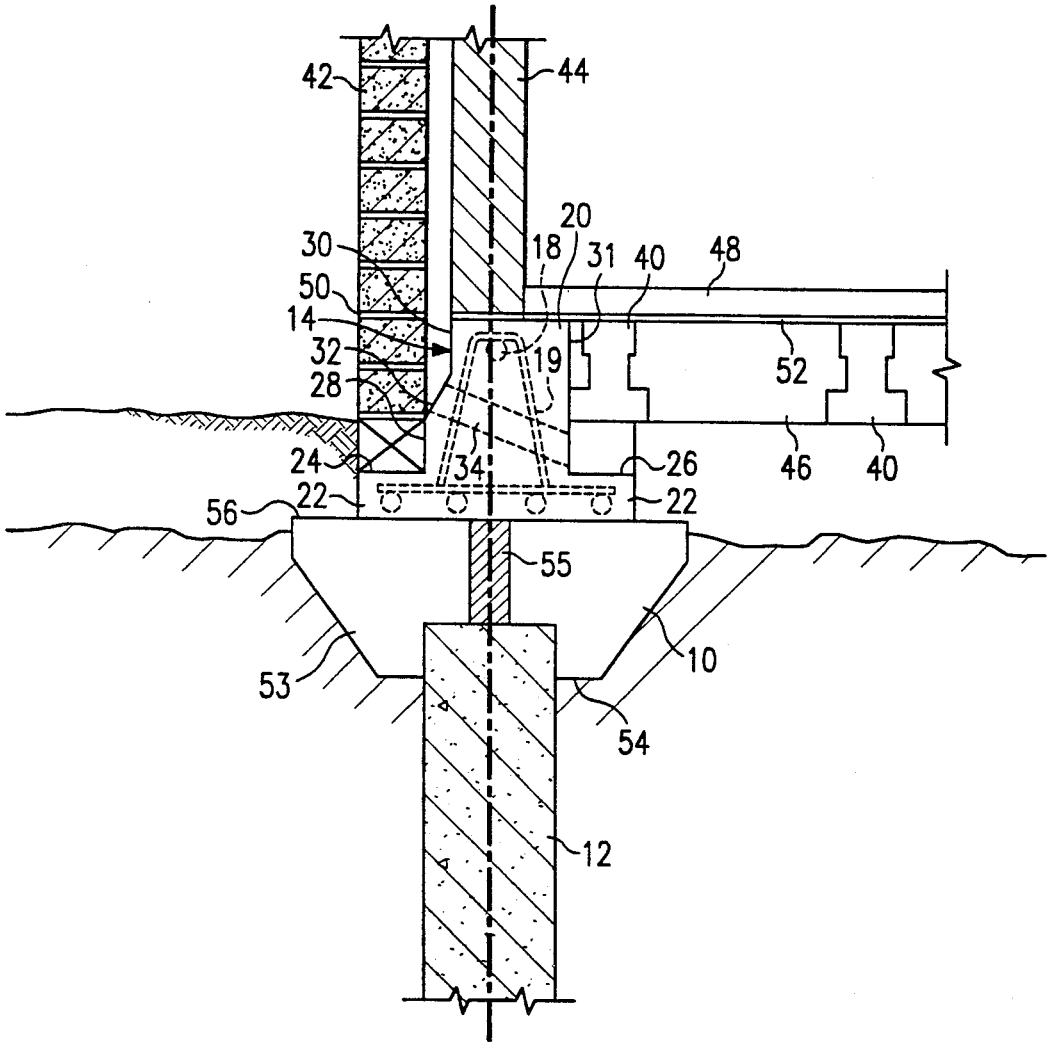
FIG. 1 shows a cross-section through a support for a building.

In the embodiment shown in FIGS. 1, 2 and 4 the beams are produced to predetermined lengths by a vibratory casting technique, each beam having mitres formed at its end during the casting operation such that they can be used in end to end relationship, or at 90° corners as shown in FIG. 4, or to produce T or X-junctions. The beam manufacturing technique is computer controlled and commences with the pre-fabrication of a reinforcement element utilizing bar cutting and welding techniques which may be automatically controlled from the computer. When a reinforcing element for a particular beam has been produced, it is labelled and transferred into a mold, the cross-section of which reproduces the cross-section of the beam but it lies inverted. With the reinforcing element held in the mold an adjustable end wall is positioned to provide a mold of the correct length and while the mold is being vibrated concrete is supplied thereto. The mold when filled, is removed from the vibrating apparatus to a first beam curing area in which the beam is initially cured to a state sufficient to enable the mold to be removed for re-use. Thereafter the beam is stored until it is removed from the manufacturing area to the site at which it is to be used. It will be apparent that by following this method a plurality of beams of considerably varying lengths can be provided in sequence so that a batch can be made up corresponding to the requirements of any particular structure which has to be built. The batch can then be shipped to the construction site and there is no need to sort out beam sizes, cut beams, etc. at the site but they can be used in the sequence dictated by the labels attached to them.

The primary support members can be provided by any suitable means, three of which are shown in FIGS. 1, 2 and 3 of the accompanying drawings.

According to the modifications shown in FIG. 3 each primary support member is formed by driving a conical shaped former into the ground at the desired location to form a correspondingly shaped hole. This former can be forced into the ground by vibratory means, by impact means or simply by applying a constant downwardly directed force thereto. An alternative method of forming the upwardly diverging hole in the ground is by use of a conical auger.

When a hole has been formed, it is filled with concrete to provide the primary support member 10. In good ground it is sufficient to provide only the support members 10 but in less good ground, that is ground where the support given to the support member 10 is insufficient, additional support can be provided by a pile 12 which is driven to a predetermined depth from the bottom of the conical hole after it has been formed. The pile can be formed in situ or can be pre-formed, in fact, any appropriate piling technique may be employed. The top of the primary support member 10 is arranged to be at a predetermined distance below ground level but in other circumstances, for example where the structure is to be built above ground level, the top of the support member 10 is spaced above ground level by using appropriate shuttering.

Figure 5:
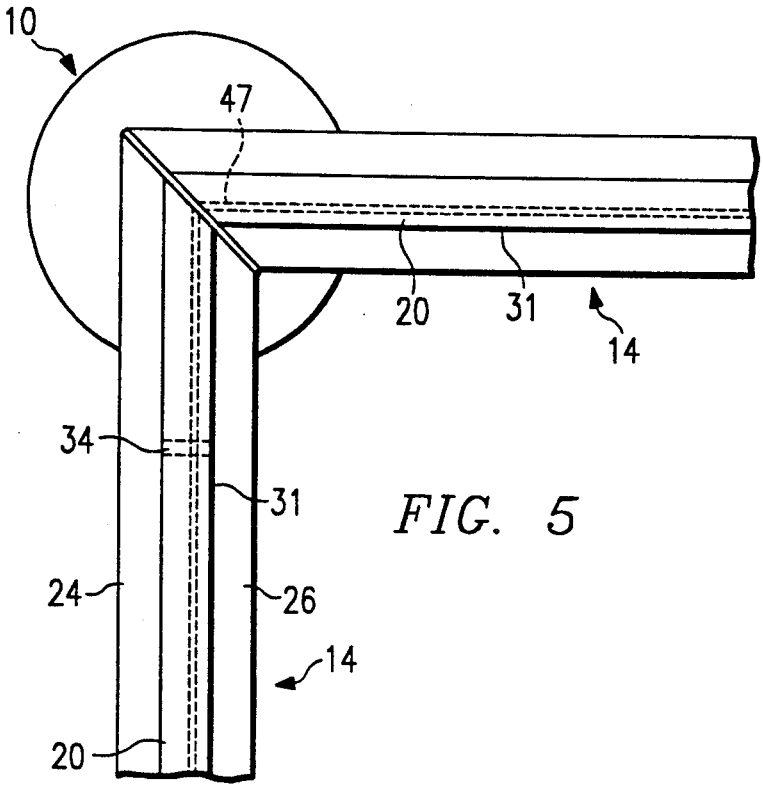
FIG. 5 shows a view similar to FIG. 4 of a support for a building including the modified beam shown in FIG. 3.

After the primary supports have been formed and the concrete therein has set, neighboring supports are spanned by a beam which is then interconnected to its neighboring beams. The beams may be arranged in end to end relationship or at any angular disposition but normally are arranged at right angles to provide L-shaped, T-shaped or X-shaped junctions. A convenient form of interconnection is achieved by laying a suitably shaped member, for example a straight member, L-shaped, T-shaped or a X-shaped member 47 in channels 34 on the top face of the beams. The members 47 are preferably of steel and can be fixed in the channels by grout, epoxy resin or any other suitable means. FIGS. 4 and 5 show a 90° or L-shaped junction.

A floor slab can then be constructed within the building. Normally the slab is constructed by means of a plurality of floor beams 40, each substantially of inverted T-shaped cross-sections which are arranged in spaced apart relationship and support therebetween a plurality of building blocks 46, the blocks and beams being combined into an integral construction by a cementitious material screed 48 which is spread over the tops of the blocks and beams. The ends of each beam 40 are arranged against or closely adjacent to the inside upright face 31 of the rectangular section 20 of the foundation beam 14. A wall is constructed on the beam and if the wall is a cavity wall, a first brick skin 42 is built upwardly from the upwardly directed surface 24 of the protrusion 22 and the second inner skin 44 from the top face of the rectangular portion 20.

A damp-proof course 50 is provided in the first brick skin 42 at the level of the top of the foundation beam 14 and a further damp-proof course 52 shown in FIGS. 1 and 2 extends across the top of the foundation beam 14 and the block and beam floor. To provide ventilation between the underfloor space and outside, the structure air bricks may be provided in the lowermost courses of the outer skin 42. Of course, ventilation is provided between the underfloor void and the cavity between the skins by means of the air passages 34 formed in the foundation beam.

It will be realized that lateral loading on the wall can produce a rotational moment on the beam, the effect of this moment in the drawing being clockwise, that is inwardly of the building. This rotational moment is resisted by the floor slab abutting the surface 31 so that a rigid construction can be ensured. There is no connection between the beam and support member which would resist a turning movement applied to the beam.

The interconnection of the beams at their ends, even at intersections, ensures that the beam forms a continuous "tray-like" structure thereby enhancing the security and stability of the construction.

As mentioned above, any suitable means can be utilized to provide the primary support member. There has been described above one form of primary support member with reference to FIG. 3. FIGS. 1 and 2 show alternatively primary support members which are the subject of Applicant's U K. patent applications 9203481 and 920059.

FIG. 1 shows a primary support member 10 comprising a pile 12 having fixed to its upper end a circular pile cap 53 pre-fabricated from concrete and having a central passage to receive a protruding length of reinforcing bar 55 of the pile 12 to which the cap 50 is attached by epoxy resin, cementitious grout or any other suitable material. The pile cap is relatively shallow and consequently very little excavation is required to enable its placement on top of the pile after the pile has been driven and the concrete surrounding the upper reinforcement 52 is removed. The pile cap converges downwardly to a lower face 54, the diameter of which is less than the diameter of the upper face 56 on which the foundation beam 14 rests.

FIG. 2 shows a further form of primary support member which comprises a hollow precast concrete downwardly converging conical member 60 which, like the embodiment shown in FIG. 3, need not have a pile protruding there below if the ground into which it is inserted is sufficiently good. Optionally a base may be provided on the member 60 but in any event it is covered by an upper slab 62 which is preferably circular. The member 60 is provided at its upper end with a steel reinforcing band 64.

In ground which is subjected to heave, that is movement on changing moisture content, it is possible to isolate the support system from the ground. For example, this is achieved during the formation of the primary supports 10 shown in FIG. 3 by introducing a slip sleeve 49 to line the conical hole before pouring concrete. The pile 12, if one is provided, may also be lined. This enables the ground surrounding the support 10 and the pile 12 to move without transmitting movement to the primary support 10. The beams 14 are also isolated from said ground movement by arranging a layer of compressible material against their undersides between the supports 10.

Various modifications can be made without departing from the scope of the invention, for example, in any of the embodiments shown in FIGS. 1 to 3 the support structures need not be conical but could be pyramidal or any other suitable upwardly diverging shape.

The beam 14 could have a longitudinal passage 16 formed therethrough as shown in FIG. 3 to reduce weight and material used. The beam illustrated in FIG. 3 has a cross-section different from that illustrated in FIGS. 1 and 2 in that it is simply an inverted T-shape which is symmetrical about its central longitudinal vertical plane. The arrangement of reinforcing members 18 in their beam differs from that described above with reference to FIGS. 1 and 2 but the most significant difference is that the beam's shape and construction shown in FIG. 3 lends itself for production by a slip casting technique. In such a technique beams can be produced in lengths of up to 150 meters and thereafter sawn off to any predetermined length.

Whereas the beam shown in FIG. 3 is suitable for use in certain applications there are others, for example in domestic building, where it is not suitable as building regulations require that the cavity between the outer and inner skins 42, 44 extends below the level of the top of the beam 14. This is achieved by the two beam cross-sections illustrated in FIGS. 1 and 2 where the outer flange 22 is extended by a distance which equates approximately to the width of the cavity between the skins 42 and 44. This results in an outward displacement of the vertical load applied to the web which consequently requires stiffening. This would normally be achieved by making a thicker web, giving rise not only to an increase in the material used in the fabrication of the beam 14 but also its manufacturing cost, transportation cost, difficulty in handling as a result of increased weight, etc. Significantly also, in view of the effective lowering of the base of the beam, it would be necessary to lower the top surface of the primary support member, this causing an increase in installation, time, effort and expense.

The present invention seeks to obviate this problem by providing an infill of beam material between the vertical outer face 30 of the beam and the effective extension of the web 22. In FIG. 1 this increase in material is provided by the step 28 delimited by the upper sloping surface 32, whereas in the embodiment shown in FIG. 2 it is provided by the step 28 which is delimited by incline face 33 extending from the top of the beam to the web 22. This relatively low amount of increased material and its particular location coupled with the placement of reinforcement within the step gives the beam the additional strength required without having to increase the web thickness 22.

It does, however, mean that the beam is handed, that is, when compared with the beam shown in FIG. 3 it has a pronounced inside and outside and obviously on erection these must be located in the correct positions. The configuration of the ends of the beams illustrated in FIG. 4 ensures that correct orientation is always achieved.

FIG. 5 illustrates a modified interconnection of the ends of two beams forming a 90° or L-shaped corner, the beam shown in FIG. 5 having a cross-section corresponding to that of FIG. 3. The corner arrangement illustrated can be used but that illustrated in FIG. 4 is the more preferable arrangement.

A further modification is shown in FIG. 2 where the air passage 34 extends horizontally through the beam from a recess cut into the angled surface 33.

Figure 6:
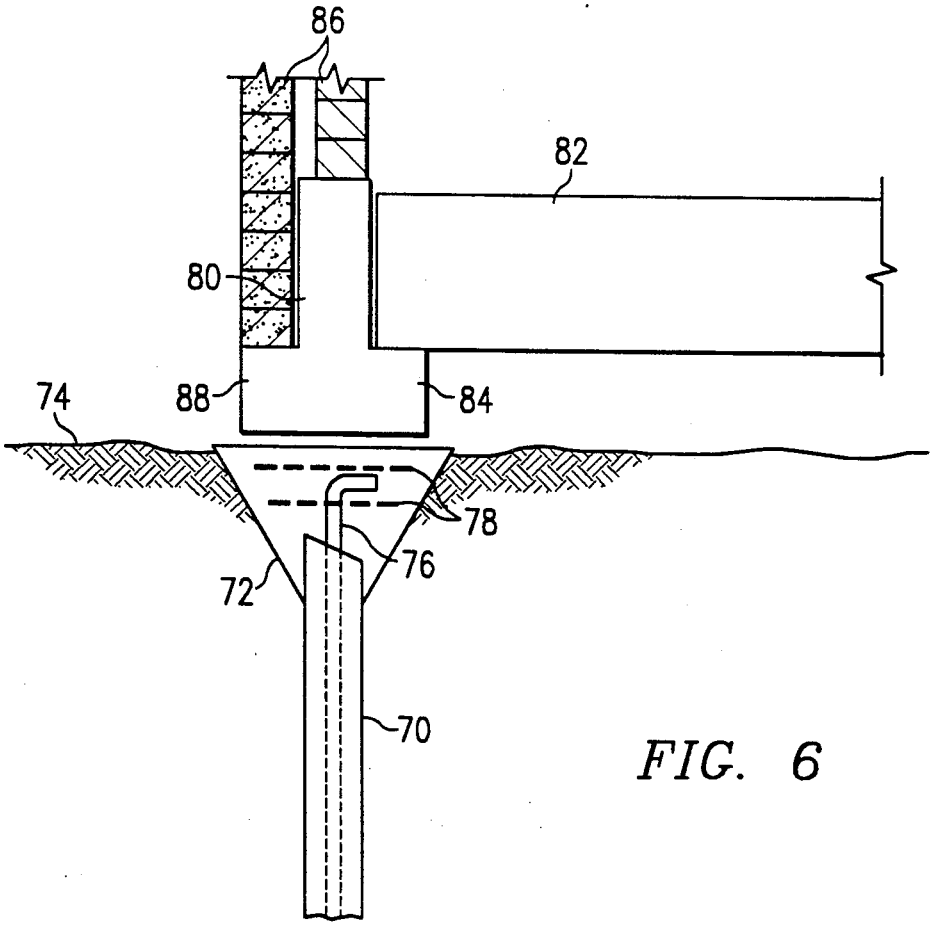
FIG. 6 shows a cross-section through a further modified support for a building.
Figure 7:
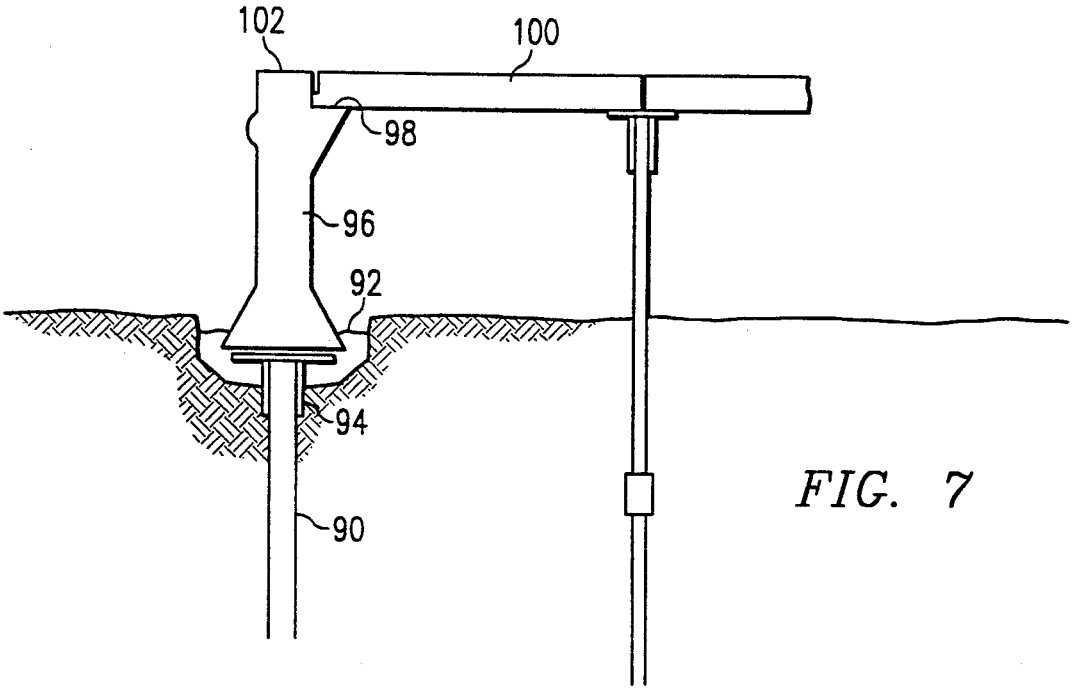
FIG. 7 shows a cross-section through a further modified support for a building.
Figure 8:
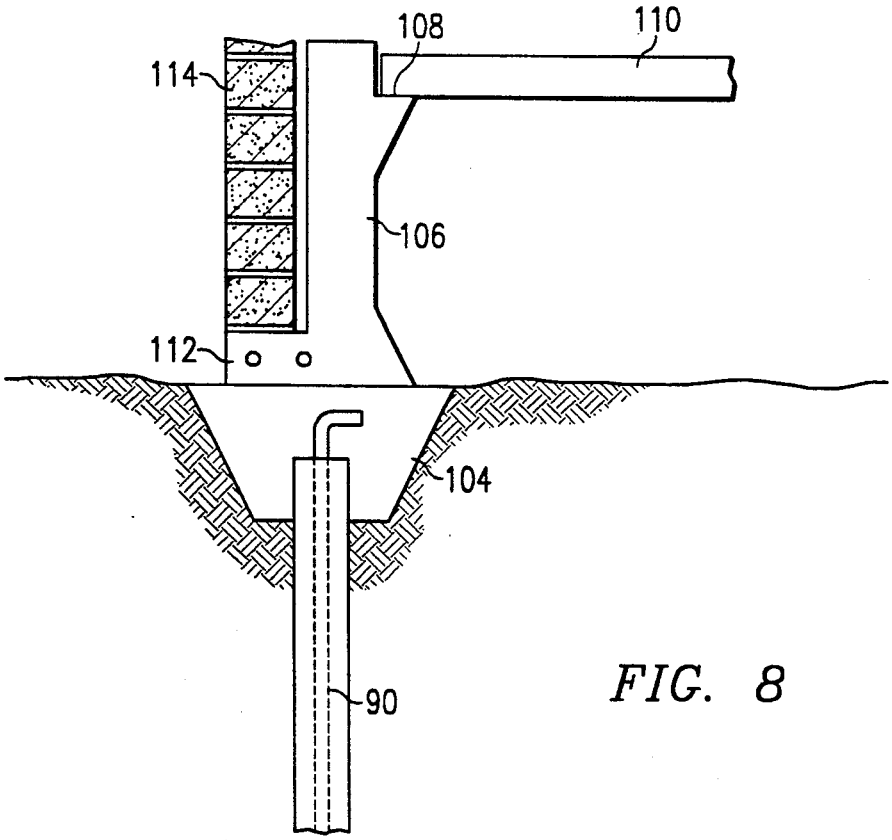
FIG. 8 shows a cross-section through a further modified support for a building.

FIGS. 6, 7 and 8 show further modified support systems for building which are not so substantial as the buildings referred to above. For example, FIG. 6 shows a foundation system for an extension to an existing dwelling. As extensions are often built in relatively inaccessible places, for example in back gardens, it is often necessary to ensure that all the components making up the extension can be manually transported to the building site.

In FIG. 6 the primary support member comprises a tubular steel pile 70 which is driven into the ground to a predetermined depth and thereafter an inverted pyramidal cavity 72 is dug around the pile. Using a hand held cutter the pile is cut off at an angle below ground level 74. A reinforcing rod 76 may then be placed in the hollow interior of the pile which is filled with concrete. The concrete filling operation is continued to fill the recess 72 but only after reinforcing meshes 78 have been placed therein. Several such primary support structures are arranged around the periphery of the extension to be built, the spacing between the structures being constant and no greater than 2 meters. In this way the beam 80 provided to span the gap between adjacent primary support structures can be moved through restricted spaces as it is not of a weight which precludes man-handling. A floor structure 82 is then arranged on the inner flange 84 of the beam. The structure is a slab cast in situ but it can also be a beam and block construction. The extension walls 86 can then be constructed on the outer flange 88 of the beam.

In a further modification shown in FIG. 7 there is provided a primary support structure for a building in the form of a conservatory. The support structure comprises a solid bar or tube 90 driven into the ground to a predetermined depth and usually into a trench 92 of relatively shallow depth which has been dug along the line of the outer wall of the conservatory. A steel cap 94 having a substantially horizontal upper surface is placed on top of the tube or bar 90 and after a plurality of such rods with caps 94 have been placed at predetermined spacing around the periphery of the conservatory, a cementitious screed is placed in the trench prior to laying a beam 96 thereon. The beam is provided with an inwardly directed lip 98 to support a rigid floor which, in the embodiment described, can be made up from a plurality of floor slabs 100 supported on intermediate support structures which do not form part of the present invention. The walls of the conservatory can then be built on the upper face 102 of the beam.

In a further modification shown in FIG. 8, which is intended to accommodate a conservatory whose base has an outer skin of bricks, a narrow tube 90 is driven as before and in the ground at its top there is formed a cavity 104 which is an inverted frusto-conical cavity or an inverted pyramidal cavity. A cap is fitted on the rod and concrete is poured into the cavity 104 to a predetermined level. When other primary support structures of this nature have been placed at a predetermined spacing the beam 106 can span the gap between adjacent structures. As before the beam has a lip 108 to support the slab 110 of the floor structure and on an outer base flange 112 of the beam there can be built the brick wall 114 forming the base of the conservatory.

It will be realized that a support system according to the present invention is relatively cheap to provide in view of the fact that less excavation is required than normal and the pre-cast beams, which can be arranged to be in lengths which are man-handleable, are pre-fabricated to a constant known standard in factory conditions.

What is claimed is:

1. A method of supporting a building structure having walls and a floor slab, comprising the steps of:

(a) forming in the ground on which the building has to be constructed a plurality of primary support members at spaced intervals;

(b) spanning the intervals between adjacent support members with pre-cast concrete beams, each beam comprising a lateral projection provided at its base on each side thereof;

(c) supporting the walls of the structure on the beams; and (d) arranging the floor slab of the structure alongside the beams to restrain inward lateral movement of the beams.

2. The method of claim 1 wherein one of the walls is supported on one projection of the beam and the floor slab on the other projection.

3. The method of claim 2 wherein one of the walls is of the structure is an inner wall that is supported on the top of the beam.

4. The method of claim 3 wherein the beams are precast to a predetermined length utilizing a vibratory molding technique and incorporate reinforcing elements.

5. The method of claim 3 wherein the beams are formed by a slip casting technique and include a central through passage.

6. The method of claim 5, wherein each beam is cut from a longer length of prefabricated beam to a length equal to the distance between two primary support members to be spanned by the beam.

7. The method of claim 1 wherein a pile projects from the bottom of each of the primary support members.

8. The method of claim 1 wherein the primary support members are formed by driving a conical steel casing into the ground at the desired location and pouring concrete into the thus formed hole.

9. The method of claim 1 wherein the primary support members are formed by driving a pre-cast reinforced concrete pile and fitting a cap member to the top thereof by passing an exposed length of reinforcement through a passage in the cap member and attaching the cap member to the pile by means of a settable material located between the cap member and the reinforcement and/or the top of the pile.

10. The method of claim 1 wherein the primary support members are formed by forcing a hollow inverted frusto-conical concrete member into the ground and fixing a slab over the top thereof.

11. The method of claim 1 wherein the floor slab is formed by laying a plurality of inverted T-shaped cross-section beams on the lateral projection from the inner side of the beam, filling the gap therebetween by blocks and applying a cementitious material over the beam and block tops.

12. The method of claim 1 wherein the lateral projection from the outer side of the beam is of a thickness greater than the thickness of the wall supported thereon and a step is provided extending between the outer face of the beam and the projection to provide support for the projection and the wall resting thereon.

* * * * *